US005423485A

United States Patent [19]

Tagusari

[11] Patent Number: 5,423,485

[45] Date of Patent: Jun. 13, 1995

[54] EXTENDED NOZZLE HEAD FOR STEAM SPRAYER

[75] Inventor: Yuhki Tagusari, Tachikawa, Japan

[73] Assignee: Comet Denki Kabushiki Kaisha, Tokyo, Japan

[21] Appl. No.: 208,533

[22] Filed: Mar. 9, 1994

[30] Foreign Application Priority Data

May 19, 1993 [JP] Japan ..... 5-025966 U

[51] Int. Cl.[6] ..... A61H 33/12

[52] U.S. Cl. ..... 239/121; 239/71; 239/124; 239/136

[58] Field of Search ..... 239/103, 120–122, 239/124, 135, 136, 71, 74

[56] References Cited

U.S. PATENT DOCUMENTS

| | | | |
|---|---|---|---|
| 2,035,724 | 3/1936 | Schwartz | 239/124 |
| 2,676,239 | 4/1954 | Sanzone et al. | 239/136 |
| 4,314,138 | 2/1982 | Itoh | 239/136 |

FOREIGN PATENT DOCUMENTS

| | | | |
|---|---|---|---|
| 583057 | 1/1925 | France | 239/136 |
| 3-45729 | 9/1991 | Japan . | |

*Primary Examiner*—Karen B. Merritt

*Attorney, Agent, or Firm*—Christensen, O'Connor, Johnson & Kindness

[57] ABSTRACT

Disclosed is an extended hand-held nozzle head (30) for attachment to a steam sprayer (1) having a steam generator (2). The hand-held nozzle head (30), which can be moved independently of the steam sprayer (1) and steam generator (2), includes a nozzle casing (32). One end of a steam supply pipe (40) is positioned in the interior of the nozzle casing (32) and the end is covered by a cap (48). The cap includes at least one opening (46) for the introduction of steam into the nozzle casing (32) from the steam supply pipe (40). The opposite end of the steam supply pipe (40) extends to the exterior of the nozzle casing (32) and attaches to one end of a flexible hose member (50). The opposite end of the flexible hose member (50) is connectable to the steam sprayer (1) for supplying steam to the nozzle head (30). A spray nozzle (36) is mounted in an exterior wall of the nozzle casing (32) for exhausting steam from the interior of the nozzle casing. A drainage pipe (42) connects to the bottom of the nozzle casing (32) for draining the interior of the nozzle casing of condensed steam. The opposite end of the drainage pipe (42) connects to a drainage reservoir (34), which collects the condensed steam drained from the interior of the nozzle casing (32).

19 Claims, 2 Drawing Sheets

EXTENDED NOZZLE HEAD FOR STEAM SPRAYER

FIELD OF THE INVENTION

The present invention generally relates to a steam sprayer and more particularly to a movably extended nozzle head for a steam sprayer that is used for facial beauty treatment or hair dressing.

BACKGROUND OF THE INVENTION

With the typical steam sprayer used for beauty treatment or hairdressing, steam is generated within a closed water tank under heating effect of a heater provided also within the water tank and this steam is sprayed through a nozzle. During this process of steam spraying, the steam is partially condensed into hot water drops along a path extending to the noble and such dangerously hot water drops might be spouted together with the steam. To avoid this, a somewhat bulky nozzle casing is combined with the nozzle so that the condensed hot water drops can be separated from a stream of steam within the nozzle casing and recirculated through a return line to the water tank.

However, such a prior art steam sprayer is inconvenient in that the steam spray nozzle casing is constructed integrally with the steam generator including the water tank. Thus, the steam spray nozzle cannot be moved without moving the water tank associated with the steam spray nozzle. Consequently, when it is desired to blow the steam directly against bare skin, for example, facial skin of the user, the user must move a part of the user's body towards the nozzle to be treated with the stream of steam. Thus, such prior art steam sprayers are disadvantageous with respect to maneuverability, and are difficult and inconvenient to use.

SUMMARY OF THE INVENTION

It is a principal object of the present invention to provide a nozzle head including a spray nozzle improved so as to be movable independently of a steam generator.

To achieve the object set forth above, a spouting nozzle for a steam sprayer is provided with a tube joint member allowing a hermetically sealed connection to be established. More specifically, flexible tube of a desired length is connected at one end to the tube joint member and at the other end to a nipple formed on an end of a steam supply pipe fixedly mounted on a nozzle casing so as to establish fluid communication between the steam sprayer and the nozzle casing.

The steam supply pipe extends through the bottom of the nozzle casing, wherein the steam supply pipe forms a substantially air-tight seal with the bottom of the nozzle casing. The nozzle casing is also connected in fluid communicating relationship with a drainage reservoir by a drain pipe extending downwardly from the bottom of the nozzle casing at a location that is spaced from the portion of steam supply pipe that extends through the nozzle casing bottom. The end of the steam supply pipe that extends into the nozzle casing is covered with a cap that includes at least one slit or through-hole. A steam spray nozzle is fixedly mounted through one side wall of the nozzle casing at an upper level.

With the extended nozzle head for steam sprayer of the invention constructed as has been generally described above, the steam generated within the steam sprayer is forwardly thrusted by its own vapor pressure through the flexible tube, then through the steam supply pipe into the nozzle casing and sprayed from the spray nozzle mounted in the nozzle casing.

The nozzle head comprises a combination of the nozzle casing, including the spray nozzle and the steam supply pipe of the drainage storing container. This nozzle head can be constructed with a significant weight saving and connected via the flexible tube in fluid communicating relationship with the steam sprayer including the steam generator. This construction allows the nozzle head to be moved about with one hand so that the nozzle can be moved towards the target part of the user's body to perform a local spraying treatment. In addition, the flexible tube allows a manifold to be used so that a plurality of nozzle heads can be connected to a common steam sprayer.

Hot water drops entrained by the stream of steam as well as hot water drops formed within the flexible tube due to condensation are forced upwardly through the steam supply pipe under the vapor pressure of steam until they reach the ceiling of the cap, and thereupon they progressively cohere together as they drip down also under the vapor pressure of steam along the side wall of the cap towards the slit. The steam being spouted out from the cap through the slit forces the water drops to exit from the cap through the slit, then the water drops drip down onto the bottom of the nozzle casing and are collected by the drainage reservoir.

The water drops which have been cooled in this manner to a temperature substantially lower than that of steam do not return to the water tank of the steam sprayer and, therefore, the various problems conventionally encountered by the steam sprayer of prior art, for example, physical turbulence due to a contact of cooled and returned water drops with heated and steam generating water, and unevenness in steam generation as well as a phenomenon of bumping (sudden uneven boiling) due to partially lowered temperature, can be avoided. Should the phenomenon of bumping occur within the steam sprayer, it will have no effect on the nozzle head.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
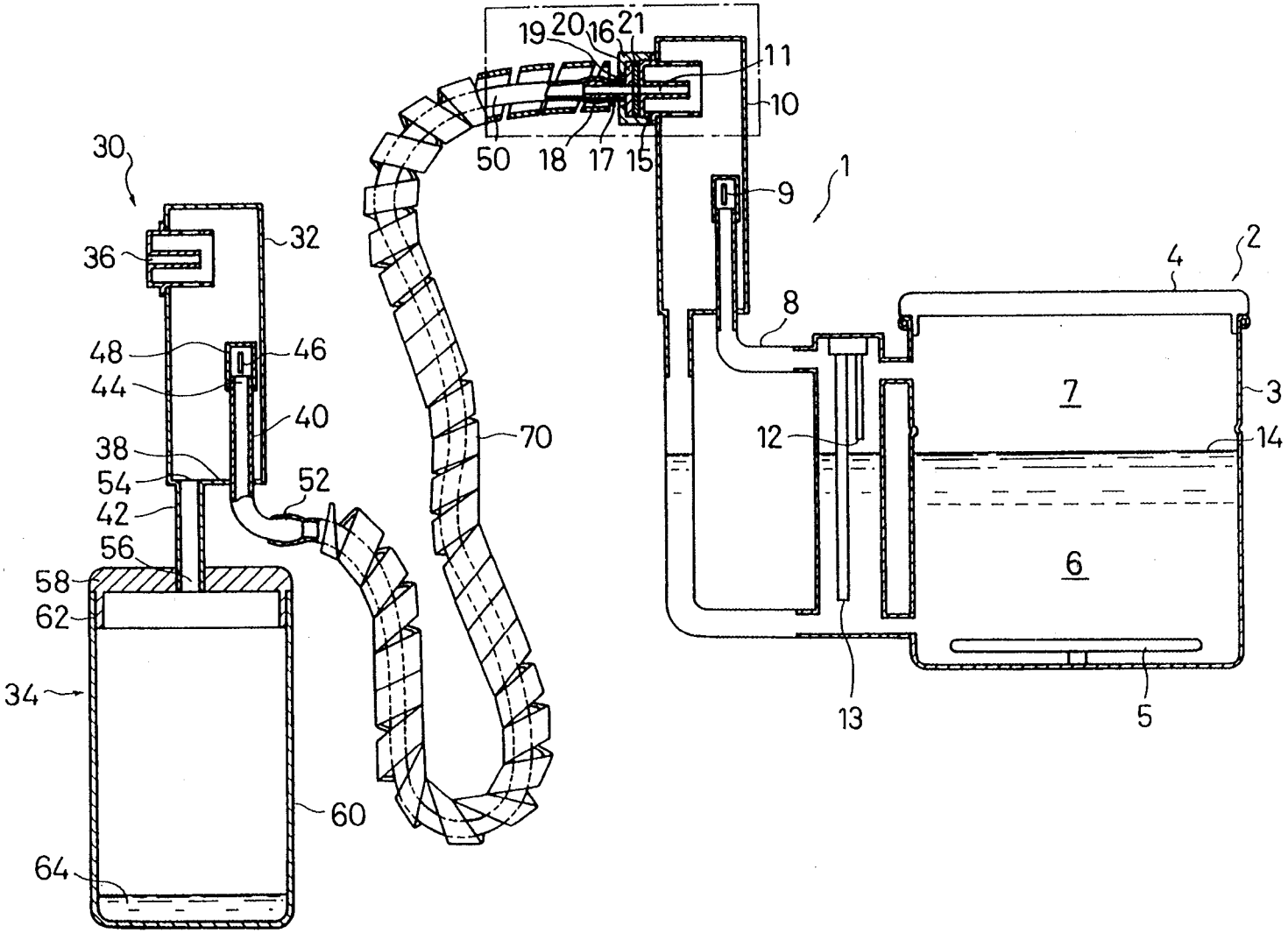
FIG. 1 is a sectional side view illustrating a movably extended nozzle head according to the invention as combined with the steam sprayer of prior art.

Referring to FIG. 1, reference numeral 1 designates the steam sprayer of well known art, for example, as disclosed in Japanese Utility Model Publication No. 3-45729. A steam generator 2 comprises a water tank 3, pressure lid 4 that hermetically seals the water tank, and a heater 5 for boiling a quantity of water 6 stored in the tank 3 so as to fill a space 7 above the quantity of water with steam generated from boiled water. This steam is driven by its own vapor pressure to flow from the steam generator 2 through a steam conduit 8, a slit 9 and then through a nozzle casing 10 to a spout nozzle 11. Reference numerals 12 and 13 designate detectors used to detect upper and lower limits, respectively, of a water level 14, and thereby to signal an abnormal situation, if it occurs.

Figure 2:
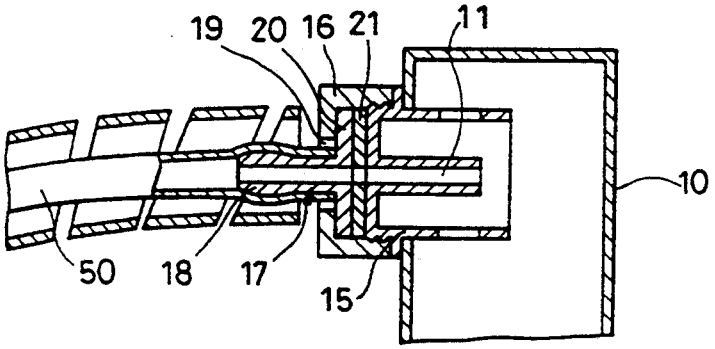
FIG. 2 is an enlarged sectional view of a portion of the inventive movably extended nozzle head enclosed by a double dotted chain line in FIG. 1.

As illustrated in an enlarged scale by FIG. 2, an outer ring 15 of the spout nozzle 11 projects outwardly from the nozzle casing 10 and is provided with a male thread, which is engaged with a female thread on a cap nut 16. The cap nut 16 has a central opening 19 through which a connector pipe 18 of a tube joint member 17 extends outwardly. The tube joint member 17 includes a flange 20, which abuts the inner face of the cap nut 16. Reference numeral 21 designates a gasket to assure a hermetical seal between the nozzle 11 and the tube joint member 17.

Reference numeral 30 (FIG. 1) designates an extended nozzle head characterized by light weight construction and maneuverability. This extended nozzle head 30 comprises a nozzle casing 32 and a drainage reservoir 34. The nozzle casing 32 includes a steam spray nozzle 36 extending through one side wall of the nozzle casing 32 at an upper level, and, in a bottom wall 38, a steam supply pipe 40 and a drainage 42 which is in fluid communication with the drainage reservoir 34. All of the foregoing components, namely the spray nozzle 36, steam supply pipe 40 and drainage 42 are mounted to the nozzle casing 32 in a substantially air-tight manner.

The steam supply pipe 40 extends into the nozzle casing 32 to its inner open end 44 which is, in turn, covered with a cap 48 having a pair of slits 46 in its side wall serving to prevent hot water drops from spouting up. While the embodiment is illustrated as the cap 48 having two slits 46 in its side wall, such slits 46 may be replaced by a plurality of through-holes. The other end of the steam supply pipe 40 is external of the nozzle casing 32 and defines a nipple 52 to which a flexible tube 50 is to be connected.

The upper end of drainage 42 forms an opening 54 in the bottom of the nozzle casing 32 at a location spaced from the steam supply pipe 40. The lower end 56 of the drainage 42 extends through a lid 58 hermetically mounted on the top of the drainage reservoir 34 and opens thereinto. Reference numeral 60 designates a drainage receptacle forming a substantial part of the reservoir 34 and serving to collect the hot water drops dripping down along the drainage 42. The receptacle 60 includes a joint 62 along its top end so that the receptacle 60 can be detachably connected to the lid 58 by means of suitable fasteners such as screws in a substantially air-tight manner. The receptacle 60 is dimensioned and configured so as to serve also as a grip which can be held in the user's palm to movably control the nozzle head.

The flexible tube 50 extends from the tube joint member 17 of the steam sprayer 1 to the nipple 52 of the extended nozzle head 30 to establish fluid communication between these two components. Preferably, the flexible tube 50 is made of silicone rubber and may be covered with a spiral band 70 of the type often used to bundle electric wires. The spiral band 70 defines a space around the flexible tube 50 without any significant impediment of its flexibility and thereby prevents the user from directly touching the hot flexible tube 50, which is heated by the steam flowing therethrough. Additionally, a layer of air formed between the flexible tube 50 and the spiral band 70 advantageously contributes to a thermal insulation and prevents the steam flowing through the flexible tube 50 from being rapidly cooled. Furthermore, the spiral band 70 functions also as a protecting material to prevent the flexible tube from being carelessly bent at a sharp angle or collapsed and resulting in interception of the steam passage during the operation.

The specific embodiment illustrated is assembled and operated in the following manner. Assembling begins with combining the cap nut 16 with the tube joint member 17 so that the connector 18 projects outwardly through the central opening 19 of the cap nut 16, and the flange 20 of the tube joint member 17 is fastened by the female thread of the cap nut 16. One end of the flexible tube 50 is connected to the connector 18 in a substantially air-tight manner and thereby to the steam sprayer 1 of known art. This is achieved by interposing the gasket 21 between the outer surface of the flange 20 and the opposed surface of the nozzle 11, then engaging the female thread on the cap nut 16 with the male thread formed on the nozzle's outer ring 15 to thereby connect the tube joint member 17 to the nozzle 11 in a substantially air-tight manner. The other end of the flexible tube 50 is sealed around the nipple 52 of the extended nozzle head 30 in a substantially air-tight manner, and the flexible tube 50 is covered with the spiral band 70 over the full length thereof.

In the steam sprayer 1 of known art, the quantity of water 6 stored in the water tank 3 is boiled by heating with the heater 5 to generate steam and thereby the space 7 above the surface of water is filled with the steam thus generated, and supplied, under its own vapor pressure, through the conduit 8 and then through the slit 9 into the nozzle casing 10. This stream of steam continues to flow through the nozzle 11, then through the flexible tube 50 and the steam supply pipe 40 into the nozzle casing 32 of the extended nozzle head 30. During passage through the flexible tube 50, the steam is partially condensed to form hot water drops which are, under pressure of the steam, forced out through the slit 46 of the cap 48 into the nozzle casing 32, are collected through the open end 54 of the drainage 42 that is provided in the bottom 38 of the nozzle casing 32, and then flow into the drainage receptacle 60. The water drops 64 collected in the receptacle 60 already in the form of water may be discharged after the receptacle 60 has been detached from the lid 58 and the receptacle 60 may be air-tightly connected again along the joint portion 62 thereof to the lid 58 after the receptacle 60 has been emptied.

The extended nozzle head 30 has a lightweight construction and the receptacle 60 is dimensioned and configured to be easily held in the user's palm so that the user can move the nozzle head 30 to a desired position around him or her with this receptacle 60 held with one hand and spray the steam through the nozzle 36 against the target pan of the user's body. The extended nozzle head 30 may be provided with a suction cup or a sling to allow the extended nozzle head 30 to be placed temporarily at a suitable location on the surface of a wall or a dressing table. This conveniently allows both hands of the user to be free when it is desired.

A manifold or other type of three or more-branched tube joint member (not shown) may be employed in place of the tube joint member 17 or connected to the flexible tube 50 to divide the steam passage into a plurality of passages and thereby to associate a plurality of extended nozzle heads 30 with a common steam sprayer 1.

As will be appreciated from the foregoing description, the extended nozzle head of the invention adapted to be used with the steam sprayer of known all allows the user to control the direction of sprayed steam with the nozzle head being held with one hand, thus improving an operation efficiency for makeup or hair dressing, since the nozzle head is connected by the flexible tube to the steam sprayer.

When a plurality of extended nozzle heads are optionally employed to be used with a common steam sprayer by dividing the flexible tube into a plurality of branches, it is conveniently possible to spray the steam against the customer along a plurality of directions or to supply a plurality of customers with the steam, in a beauty salon or a barber shop.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hand-held extended nozzle head for use in combination with a steam sprayer having a tank for holding water, and a heater connected to the tank for heating the water and producing steam, comprising:

(a) a flexible hose member having first and second ends, the first end being connectable in fluid communication to the steam sprayer for receiving steam therefrom;

(b) a nozzle casing having an exterior wall including a bottom, defining an interior region, and a steam supply pipe having first and second ends, the first end of the steam supply pipe opening in fluid communication with the interior region, and the second end of the steam pipe extending through the exterior wall and connected in fluid communication to the second end of the flexible hose member;

(c) a cap covering the first end of the steam supply pipe, the cap having at least one opening for introducing steam into the interior region of the nozzle casing;

(d) a spray nozzle mounted in the exterior wall for exhausting steam to the environment from the interior region of the nozzle casing;

(e) a drainage pipe having first and second ends, the first end connected in fluid communication to the bottom of the nozzle casing for draining the interior region of the nozzle casing of condensed steam; and (f) a drainage reservoir connected in fluid communication to the second end of the drainage pipe for collecting condensed steam drained from the interior region of the nozzle casing, the drainage reservoir forming a closed container for preventing condensed steam from flowing back to the tank for holding water.

2. The hand-held extended nozzle head of claim 1, wherein the spray nozzle is mounted in the exterior wall of the nozzle casing at a position above the cap and the first end of the drainage pipe.

3. The hand-held extended nozzle head of claim 1, wherein the steam supply pipe extends through the bottom of the nozzle casing, at a distance spaced apart from the drainage pipe.

4. The hand-held extended nozzle head of claim 1, wherein the drainage reservoir is cylindrical in shape, having a diameter small enough to be held in a person's hand.

5. The hand-held extended nozzle head of claim 1, wherein the flexible hose member is a silicone rubber tube.

6. The hand-held extended nozzle head of claim 5, wherein the flexible hose member includes a spiral band encircling and spaced apart from the silicone rubber tube.

7. The hand-held extended nozzle head of claim 1, wherein the drainage reservoir comprises a first part and a second part, the second part being detachable from the first part for emptying the drainage reservoir of collected condensed steam.

8. A steam sprayer, comprising:

(a) a tank for holding water;

(b) a heater connected to the tank for heating the water and producing steam;

(c) a stem supply pipe having first and second ends, the first end of the steam supply pipe connected in fluid communication to the tank for receiving steam therefrom;

(d) a nozzle casing having an exterior shell defining an interior region, the interior region of the nozzle casing connected in fluid communication to the second end of the stem supply pipe for receiving steam therefrom and trapping condensed steam;

(e) a first spray nozzle having first and second ends, the first end connected in fluid communication to the interior of the nozzle casing for receiving steam therefrom;

(f) a flexible hose member having first and second ends, the first end of the hose member being connectable in fluid communication to the second end of the first spray nozzle for receiving steam therefrom; and (g) a second spray nozzle having first and second ends, the first end of the second spray nozzle connected in fluid communication to the second end of the flexible hose member for receiving steam therefrom, and the second end of the second spray nozzle for exhausting steam.

9. The steam sprayer of claim 8, wherein the nozzle casing includes a bottom, further comprising:

(a) a drainage pipe having first and second ends, the first end of the drainage pipe connected in fluid connection to the bottom of the nozzle casing for draining the interior region of the nozzle casing of condensed steam; and (b) a drainage reservoir connected in fluid communication to the second end of the drainage pipe for collecting condensed steam drained from the interior region of the nozzle casing.

10. The steam sprayer of claim 9, wherein the drainage reservoir is cylindrical in shape, having a diameter small enough to be held in a person's hand.

11. The steam sprayer of claim 10, wherein the steam supply pipe extends through the bottom of the nozzle casing, at a distance spaced apart from the drainage pipe.

12. The steam sprayer of claim 9, wherein the drainage reservoir comprises a first part and a second part, the second part being detachable from the first part for emptying the drainage reservoir of collected condensed steam.

13. The steam sprayer of claim 8, further comprising a cap covering the second end of the steam supply pipe, the cap having at least one opening for introducing steam into the interior region of the nozzle casing.

14. The steam sprayer of claim 13, wherein the first spray nozzle is mounted in the exterior shell of the nozzle casing at an elevation above the cap.

15. An improved steam sprayer of the type having a tank for holding water, a heater connected to the tank for heating the water and producing steam, and a first spray nozzle connected in fluid communication to the tank for exhausting steam therefrom, wherein the improvement comprises:

(a) a flexible hose member having first and second ends, the first end connected in fluid communication to the first nozzle of the steam sprayer for receiving steam therefrom;

(b) a nozzle casing having an exterior wall including a bottom, defining an interior region, and a steam supply pipe having first and second ends, the first end of the steam supply pipe opening in fluid communication with the interior region, and the second end of the steam pipe extending through the exterior wall and connected in fluid communication to the second end of the flexible hose member;

(c) a cap covering the first end of the steam supply pipe, the cap having at least one opening for introducing steam into the interior region of the nozzle casing;

(d) a second spray nozzle mounted in the exterior wall for exhausting steam to the environment from the interior region of the nozzle casing;

(e) a drainage pipe having first and second ends, the first end of the drainage pipe connected in fluid communication to the bottom of the nozzle casing for draining the interior region of the nozzle casing of condensed steam; and the drainage reservoir forming a closed container to prevent condensed steam from flowing back into the tank.

16. The improved steam sprayer of claim 15, wherein the second spray nozzle is mounted in the exterior wall of the nozzle casing at a position above the cap and the first end of the drainage pipe.

17. The improved steam sprayer of claim 15, wherein the steam supply pipe extends through the bottom of the nozzle casing, at a distance spaced apart from the drainage pipe.

18. The improved steam sprayer of claim 15, wherein the drainage reservoir is cylindrical in shape, having a diameter small enough to be held in a person's hand.

19. The improved steam sprayer of claim 15, wherein the drainage reservoir comprises a first part and a second part, the second part being detachable from the first part for emptying the drainage reservoir of collected condensed stem.

* * * * *

UNITED STATES PATENT AND TRADEMARK OFFICE

CERTIFICATE OF CORRECTION

PATENT NO. : 5,423,485
DATED : June 13, 1995
INVENTOR(S) : Y. Tagusari

It is certified that error appears in the above-indentified patent and that said Letters Patent is hereby corrected as shown below:

| COLUMN | LINE | |
|---|---|---|
| 1 | 18 | "noble" should read --nozzle-- |
| 4 | 58 | "pan" should read --part-- |
| 5 | 5 | "all" should read --art-- |
| 6 (Claim 8, | 21 line 5) | "stem" should read --steam-- |
| 8 (Claim 15, | 10 line 30) | "and the" should read --and, the-- |
| 8 (Claim 19, | 28 line 5) | "stem." should read --steam.-- |

Signed and Sealed this

Nineteenth Day of September, 1995

*Attest:*

Bruce Lehman

BRUCE LEHMAN

*Attesting Officer*

*Commissioner of Patents and Trademarks*